United States Patent [19]

Tulgan

[11] Patent Number: 4,925,070

[45] Date of Patent: May 15, 1990

[54] BACKPACK INCLUDING RESTRAINT MEANS

[76] Inventor: Terri R. Tulgan, 342 Southwick Rd., Westfield, Mass. 01085

[21] Appl. No.: 308,530

[22] Filed: Feb. 10, 1989

[51] Int. Cl.[5] ..... A45F 3/04

[52] U.S. Cl. ..... 224/202; 224/209; 224/259; 224/901; 2/DIG. 6

[58] Field of Search ..... 224/201, 202, 204–216, 224/224–228, 162, 242, 245, 246, 257–265, 901, 153, 235–237, 240; 150/101, 102, 113; 190/101, 102, 116; 2/DIG. 6

[56] References Cited

U.S. PATENT DOCUMENTS

| | | | |
|---|---|---|---|
| 1,795,880 | 3/1931 | Mullins | 224/202 |
| 2,407,787 | 9/1946 | Kernahan | 224/236 |
| 3,063,718 | 11/1962 | Steinkamp | 2/DIG. 6 |
| 3,198,300 | 8/1965 | Tuttle | 224/162 |
| 3,346,155 | 10/1967 | Oechsle | 224/153 |
| 4,434,920 | 3/1984 | Moore | 224/215 |
| 4,639,946 | 2/1987 | Koenig | 2/DIG. 6 |
| 4,674,664 | 6/1987 | Simon | 224/215 |
| 4,693,402 | 9/1987 | Comeau | 224/215 |
| 4,739,913 | 4/1988 | Moore | 224/215 |

FOREIGN PATENT DOCUMENTS

| | | | |
|---|---|---|---|
| 0990180 | 1/1983 | U.S.S.R. | 224/257 |

OTHER PUBLICATIONS

Strapet, 10/30/78, (adverstisement), picture of Backpack on p. 4.

*Primary Examiner*—Henry J. Recla
*Assistant Examiner*—Casey Jacyna
*Attorney, Agent, or Firm*—Paul J. Cook

[57] ABSTRACT

A backpack is provided which is suitable for use by a child. The backpack has a main compartment for storing articles and a handle attached to cord means extending through a main wall of the main compartment. The handle can be secured to an outside surface of the main wall and can be removed by hand from the outside surface when it is desired to restrain the child by the cord means. The cord means is stored within the compartment when not in use. A subcompartment can be added for securing the handle and for storing the cord means.

10 Claims, 3 Drawing Sheets

BACKPACK INCLUDING RESTRAINT MEANS

BACKGROUND OF THE INVENTION

The present invention relates to a backpack construction having restraint means suitable for use by a child. More particularly, the present invention relates to a backpack construction provided with means for restraining a child at a distance which means can be stored within the backpack.

Backpacks have evolved through the years into means for comfortably and efficiently carrying articles conveniently. These backpacks are popular among young people including small children since permit carrying articles without encumbering the hands and arms of the user. In the case of small children, several features found on backpacks for adults usually are not required for children such as those means which distribute load such as a skeletal frame or otherwise rigid framework or internal stiffeners since the child usually wears the backpack during play for a short time. In order to permit the child to derive the most enjoyment from play, it is desirable to permit the child freedom of movement under supervision by an adult. This is in contrast to an environment whereby the child is restrained by the adult by a harness or other such type means. However, it would also be desirable to provide the adult with means for quickly restraining the child under conditions where the child might be hurt if continued to be allowed to play without restraint.

It would be desirable also to provide a means for permitting a child to play without restraint while providing an accompanying adult with the means for restraining the child quickly and effectively. Furthermore, it would be desirable to provide such a means which can be stored quickly to permit the child to resume play without restraint.

SUMMARY OF THE INVENTION

The present invention provides a backpack suitable for use by a child having a main compartment for storing articles and which operationally can include a subcompartment formed on an outside surface of the main compartment. A handle is provided which is attached to cord means which in turn extends through a wall of either the main compartment or the subcompartment at one point or at two spaced-apart points and whereby the cord means is secured within the interior portion of the main compartment or the subcompartment. The handle can be secured to an outside surface of the backpack for easy access by hand so that it can be utilized to be grasped and extend the cord means in order to restrain the child. After restraint is no longer required, the cord means is stored within the compartment or subcompartment and the handle is secured to the outside surface of the backpack.

DETAILED DESCRIPTION OF SPECIFIC EMBODIMENTS

Figure 2:
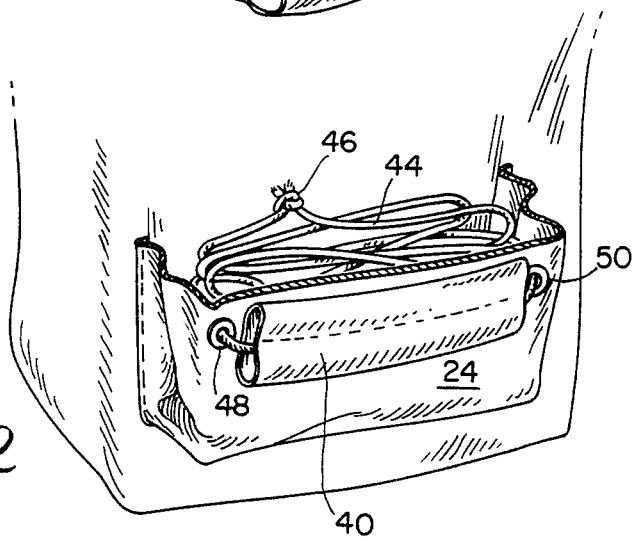
FIG. 2 is a cutaway view of the cord means and handle positioned on the backpack of this invention.

Referring to the drawings, the backpack 10 includes a main compartment 12 formed from a top wall 14, a back main wall 16, a bottom 18 and a front main wall 20. Access to the main compartment 12 is attained by opening and closing a zipper 22. To the main back wall 12 is secured, such as by sewing, a subcompartment 24 formed from a top wall 26, a main back wall 16, side walls 28 and 30, subcompartment wall 31 and bottom 32. Access to subcompartment 24 is attained by opening and closing zipper 34. To wall 31 is secured such as by sewing a strip of a material 36 which mates with strip 38 which in turn is attached to handle 43. The strips 36 and 38, when contacted to each other are held to each other by friction such as material sold under the tradename, VELCRO. Through hollow handle 40 is threaded cord 44, the ends of which are tied to form a knot 46. As shown in FIG. 2, the handle 40 is secured to subcompartment 24 by means of contacting the strips 36 and 38 together. The free portion of cord 44 are passed through holes 48 and 50 and the cord 44 is stored within subcompartment 24.

Figure 3:
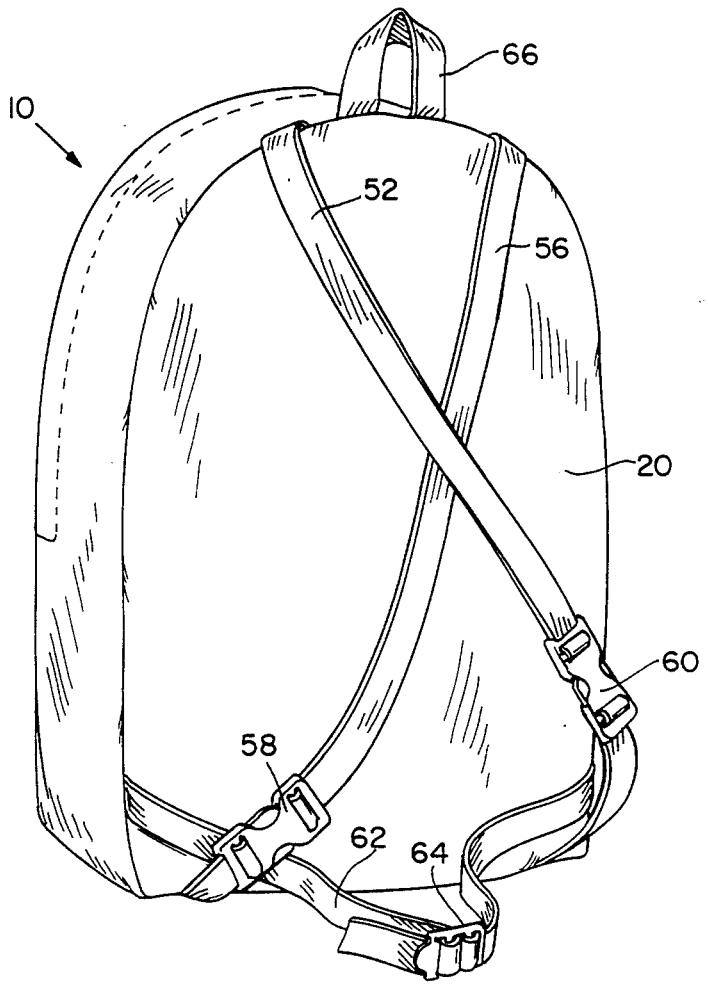
FIG. 3 is a view of the front surface portion of the backpack of this invention.

As shown in FIG. 3, the backpack 10 is secured to a child by means of cross-straps 52 and 56, the ends of which are secured to the backpack surface 20 such as by sewing. The lengths of the straps 52 and 56 can be adjusted by means of buckles 58 and 60. An adjustable waist strap 62 can be provided with a buckle 64, if desired. The straps 52 and 56 extend over the shoulders of the child and across the front of the child in order to secure the backpack to the back of the child. The backpack can also be provided with a loop 66 in order to hang the backpack on a hook when not in use.

In use, the backpack is carried by the child on the child's shoulders and the handle 40 is secured to the subcompartment 24 as shown in FIG. 2. When it is desired to restrain the child, the accompanying adult can grab the exposed handle 40 by hand and pull the cord 44 until the knot 46 prevents further exposure of the cord 44 so that the child is pulled toward the adult. Knots also can be tied to the ends of cord 44 independently to prevent their being passed through holes 48 and 50. The straps 52 and 56 prevent the backpack from slipping from the child's back during restraint. When it is desired that the child resume play, the subcompartment 24 is opened by means of zipper 34 and the cord 40 is into the subcompartment until strips 36 and 38 contact each other. Then the zipper 34 is closed and the child can resume play.

In one embodiment, the backpack of this invention need not be provided with a subcompartment and the strip 36 can be secured directly to wall 16 and the cord 44 can extend through holes 48 and 50 into compartment 12. In this embodiment, the backpack can be used in the manner described above.

Figure 1:
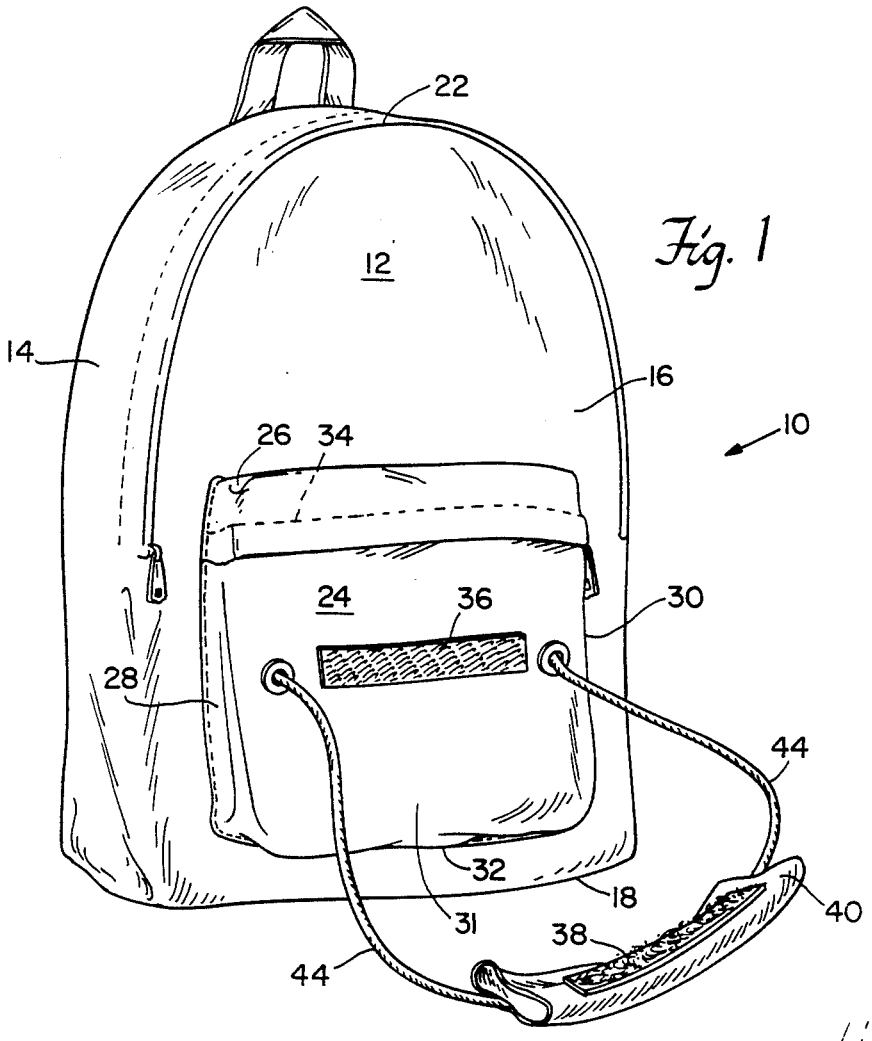
FIG. 1 is a view of the back surface portion of the backpack construction of this invention.
Figure 4:
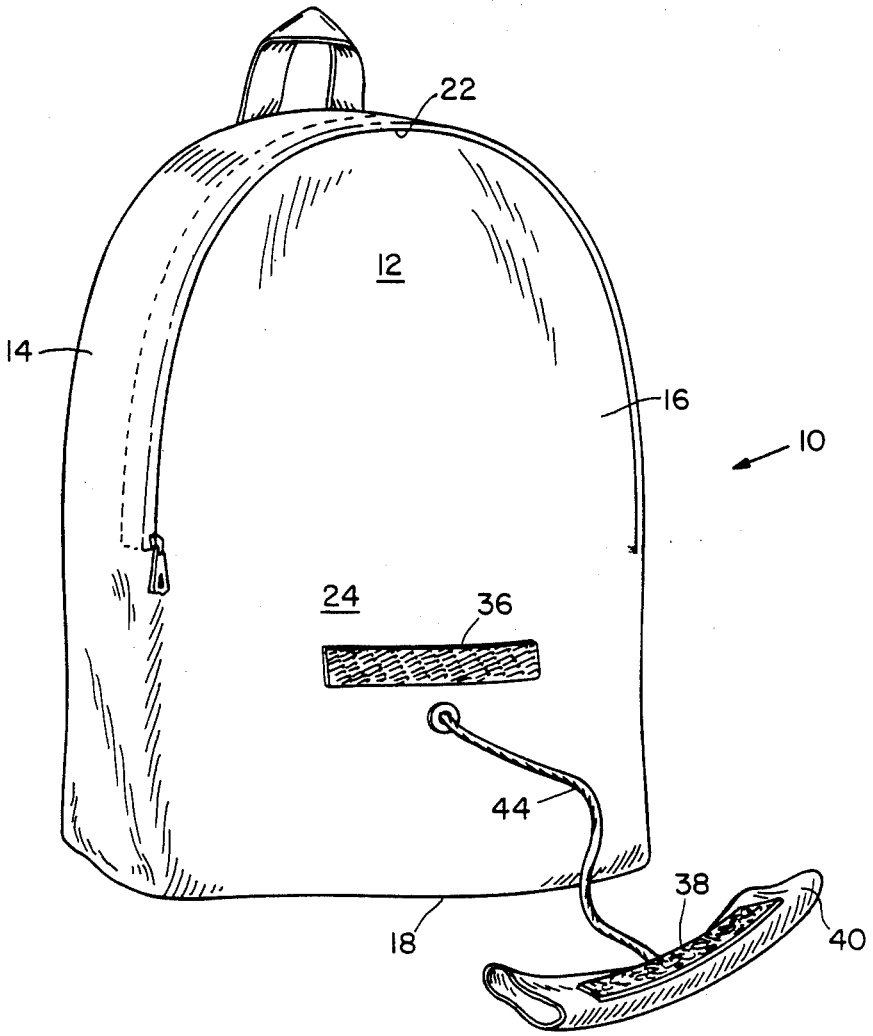
FIG. 4 is a view of the back surface portion of the backpack construction of another embodiment of this invention.

FIG. 4 shows a backpack construction utilizing one cord where the numbered elements are the elements labeled with the same numbers shown in FIG. 1.

I claim:

1. In a back pack suitable for use by a child, said back pack having a main compartment for storing articles, said main compartment being provided with means for opening and closing access to said main compartment, and means for securing the backpack to the back of a child, the improvement which comprises, a handle attached to cord means, said cord means extending through a main wall of said main compartment, means for securing said cord means within an interior portion of said main compartment, and means for securing said handle to an outside surface of said main wall and for removing said handle by hand from said outside surface.

2. The backpack of claim 1 wherein said cord means extends through said main wall at two spaced-apart points.

3. The backpack of claim 1 wherein said cord means extends through said main wall at one point.

4. The backpack of claim 1 wherein said cord means is secured by tieing two ends of a single cord to each other.

5. The backpack of claim 1 wherein said cord means is secured by tieing a knot in each of two ends of a single cord.

6. In a backpack suitable for use by a child, said back pack having a main compartment for storing articles, a subcompartment smaller then said main compartment secured to an outside main wall of said main compartment, first means for opening and closing access to said main compartment second means for opening and closing said subcompartment, and strap means for securing the backpack to the back of a child, the improvement which comprises, a handle attached to cord means, said cord means extending through an outside wall of said subcompartment, means for securing said cord means within an interior portion of said subcompartment, and means for securing said handle to an outside surface of said outside wall of said subcompartment and for removing said handle by hand from said outside surface of said outside wall.

7. The backpack of claim 6 wherein said cord means extends through said outside surface of said outside wall of said subcompartment at two spaced-apart points.

8. The backpack of claim 6 wherein said cord means extends through said outside surface of said outside wall of said subcompartment at one point.

9. The backpack of claim 5 wherein said cord means is secured by tieing two ends of a single cord to each other.

10. The backpack of claim 6 wherein said cord means is secured by tieing a knot in each of two ends of a single cord.

* * * * *